United States Patent [19]

Caldwell et al.

[11] 4,142,005

[45] Feb. 27, 1979

[54] PROCESS FOR PREPARING AN ELECTRODE FOR ELECTROLYTIC CELL HAVING A COATING OF A SINGLE METAL SPINEL, $Co_3O_4$

[75] Inventors: Donald L. Caldwell; Mark J. Hazelrigg, Jr., both of Lake Jackson, Tex.

[73] Assignee: The Dow Chemical Company

[21] Appl. No.: 661,879

[22] Filed: Feb. 27, 1976

[51] Int. Cl.[2] ..... C25D 17/10; C25B 11/04; C25B 11/10

[52] U.S. Cl. ..... 427/126; 204/290 F; 427/115; 427/126; 427/380; 427/120

[58] Field of Search ..... 427/126, 380, 118, 120, 427/58, 115; 204/290 F

[56] References Cited

U.S. PATENT DOCUMENTS

| | | | |
|---|---|---|---|
| 1,902,185 | 3/1932 | Rothe | 427/126 |
| 2,631,115 | 3/1953 | Fox | 204/290 F |
| 3,081,200 | 3/1963 | Tompkins | 427/126 |
| 3,663,280 | 5/1972 | Lee | 427/126 |
| 3,711,397 | 1/1973 | Martinsons | 204/290 F |
| 3,954,512 | 5/1976 | Kanter | 427/126 |
| 3,977,958 | 9/1976 | Caldwell et al. | 204/290 F |
| 4,042,483 | 8/1977 | Bouy et al. | 427/58 |

FOREIGN PATENT DOCUMENTS

| | | | |
|---|---|---|---|
| 909299 | 10/1962 | United Kingdom | 427/126 |
| 1206863 | 9/1970 | United Kingdom | 427/126 |

OTHER PUBLICATIONS

*Organic Chemistry*, R. T. Morrison, et al., copyright, 1959, by Allyn and Bacon, Inc., inside back cover.

*Primary Examiner*—John D. Smith
*Attorney, Agent, or Firm*—W. J. Lee

[57] ABSTRACT

Electrodes particularly suitable for use as anodes in electrolytic cells are prepared by coating an electrically-conductive substrate with a thermally-decomposable inorganic cobalt compound and then thermally oxidizing the inorganic cobalt compound under conditions at which the single-metal spinel, $Co_3O_4$, is formed.

16 Claims, No Drawings

PROCESS FOR PREPARING AN ELECTRODE FOR ELECTROLYTIC CELL HAVING A COATING OF A SINGLE METAL SPINEL, $CO_3O_4$

BACKGROUND OF THE INVENTION

The present invention relates to the providing of metal electrodes in processes in which electrolytic decomposition is performed by passing an electric current from one electrode to another through an aqueous electrolyte. More particularly, the present invention pertains to the use of metal anodes instead of the historically popular graphite anodes in the electrolysis of aqueous solutions of salt to form chlorine and caustic. Even more particularly, the present invention pertains to the use of electrically-conductive substrates having substantially-insoluble electrically-conductive metal oxide coatings as anodes in a chlor-alkali diaphragm cell.

The problems associated with the use of graphite anodes in such chlor-alkali cells are well known to practitioners of the art. As the graphite wears away, the distance between cathode and anode increases and this causes loss of power efficiency. Furthermore, the undesirable carbon products created by the chemical, electrochemical, and physical depletion of the graphite anodes are substantial enough to create a need for remedy.

DISCUSSION OF PRIOR ART

There are many materials which have the electrical conductivity required of an electrode. The difficulty in the art has been in finding an economically feasible electroconductive material which will resist chemical and/or electrochemical attack over extended periods of time without appreciable loss of its conductivity or of its dimensions.

There are electroconductive materials which retain their high conductivity quite well, but which are eroded away by chemical or electrochemical attack, e.g., graphite.

There are electroconductive materials which resist chemical or electrochemical attack by forming a protective oxide layer, but the protective oxide coating also reduces the ability of the electrode to provide efficient flow of current. The metals which form the protective oxide layer are called film-formers; titanium is a notable example of these film-formers.

There are expensive noble metals (e.g., platinum) which work well as electrodes, but which are not economically feasible for large scale use. Various attempts have been made to deposit coatings of these expensive noble metals onto less expensive substrates in order to provide electrodes with surfaces that are suitable dimensionally and electrically; that is, which will withstand the chemical or electrochemical attack yet not suffer losses of conductivity.

Various attempts have been made to provide anodes for electrolytic chlorine cells which are long-lived and are more efficient than graphite in regards to consumption of electric power. Electrodes prepared of, e.g., titanium, tantalum, or tungsten have been coated with various metals and mixtures of metals of the group known as the platinum group metals. These platinum group metals have been deposited on the various conductive substrates as metals and as oxides. Representative patents which teach the use of the platinum group metals as oxides are, e.g., U.S. Pat. Nos. 3,632,498; 3,711,385; and 3,687,724. German Pat. No. 2,126,840 teaches an electrode comprising an electroconductive substrate having an electrocatalytic surface of a bimetal spinel which requires a binding agent. The required binding agent is defined as a platinum group metal or compound and the bimetallic spinel is defined as an oxycompound of two or more metals having a unique crystal structure and formula. The patent teaches that the bimetal spinel is not effective in the absence of the platinum binder.

U.S. Pat. No. 3,399,966 teaches an electrode coated with $CoO_m\ nH_2O$, where m is 1.4 to 1.7 and n is 0.1 to 1.0. South African Pat. No. 71/8558 teaches the use of cobalt-titanate as a coating for electrodes.

U.S. Pat. No. 3,632,498 teaches an electrode comprising a conductive, chemically resistant base coated with at least one oxide of a film-forming metal and at least one oxide of a platinum group metal.

In a copending application Ser. No. 531,934 filed Dec. 12, 1974, now U.S. Pat. No. 3,977,958, which is a continuation-in-part of Ser. No. 425,410, filed Dec. 17, 1973, now abandoned, it is disclosed that organic cobalt compounds are employed in preparing electrodes comprising $Co_3O_4$ on an electroconductive substrate. U.S. Pat. No. 3,977,958 is incorporated herein by reference.

Other patents which disclose various spinel or other metal oxide coatings on electroconductive substrates are, e.g., U.S. Pat. Nos. 3,711,397; 3,704,644; 3,689,382; 3,689,384; 3,672,973; 3,711,382; 3,773,555; 3,103,484; 3,775,284; 3,773,554; and 3,663,280.

There is a need for electrode coating materials which are inexpensive, readily available, resist chemical or electrochemical attack, and which do not suffer significant losses of conductivity over extended periods of operation. This need is met by the present invention wherein an electroconductive substrate is coated with an effective amount of a single-metal spinel of $Co_3O_4$ by a method described hereinafter. An "effective amount" of the coating on the substrate means: (1) in the case where film-forming substrates or chemically stable substrates are used, an "effective amount" is that amount which will provide sufficient current flow between the electrolyte and the substrate; and (2) in the case where the substrate is not a film-former and is not chemically stable, an "effective amount" is enough not only to provide sufficient current flow between the electrolyte and the substrate but also to substantially protect the substrate from chemical or electrochemical attack.

The present invention provides a highly efficient electrode which does not require expensive metals of the platinum group; this provides an economic advantage.

SUMMARY OF THE INVENTION

It has now been found, unexpectedly, that highly efficient, insoluble electrodes are prepared by depositing on a suitable electroconductive substrate a coating of a single-metal spinel $Co_3O_4$ formed by thermal decomposition of inorganic cobalt compounds. Preferably, the electroconductive substrate is one of the film-forming metals which are found to form a thin protective oxide layer when subjected directly and anodically to the oxidizing environment of an electrolytic cell. Electroconductive substrates which are not film-forming metals are also operable, but generally are not preferred due to the possibility of chemical attack of the substrate if it contacts the electrolyte or corrosive substances.

Furthermore, it has been found to be advantageous to co-deposit a "modifier oxide" along with the single-metal spinel. The "modifier oxides" may be, preferably, one or more of the oxides of, e.g., titanium, tantalum, tungsten, zirconium, vanadium, lead, niobium, cerium, or molybdenum.

DETAILED DESCRIPTION OF PREFERRED EMBODIMENTS

Preferably, the electroconductive substrate is one of the film-forming metals selected from the group consisting of titanium, tantalum, tungsten, zirconium, molybdenum, niobium, hafnium, and vanadium. Most preferably the electroconductive substrate is titanium, tantalum, or tungsten. Titanium is especially preferred.

Alloys of the above named film-forming metals may also be used, such as titanium containing a small amount of palladium or aluminum and/or vanadium. A Beta III alloy containing Ti, Sn, Zr, Mo is operable. Many other possible alloys will be apparent to persons skilled in the art.

The function of the substrate is to support the electroconductive film of single-metal spinel ($Co_3O_4$) and to conduct electrical current which is conducted by and through the spinel coating. Thus, it can be seen that there is a large number of possibilities for selection of the substrate. The film-forming substrates are desirable for use in the present invention in those instances in which the single-metal-spinel coated electrode is used as an anode in an electrolytic diaphragm chlorine cell. The ability of the electrically conductive film-forming substrate to form a chemically-resistant protective oxide layer in the chlorine cell environment is important in the event a portion of the substrate becomes exposed to the environment of the cell.

Modifier oxides may be incorporated into the $Co_3O_4$ coating to provide a tougher coating. The modifier oxide is selected from among the following listed groups:

Group III-B (Scandium, Yttrium)
Group IV-B (Titanium, Zirconium, Hafnium)
Group V-B (Vanadium, Niobium, Tantalum)
Group VI-B (Chromium, Molybdenum, Tungsten)
Group VII-B (Manganese, Technetium, Rhenium)
Lanthanides (Lanthanum through Lutetium)
Actinides (Actinium through Uranium)
Group III-A Metals (Aluminium, Gallium, Indium, Thallium)
Group IV-A Metals (Germanium, Tin, Lead)
Group V-A Metals (Antimony, Bismuth).

The modifier oxide is, preferably, an oxide of cerium, bismuth, lead, vanadium, zirconium, tantalum, niobium, molybdenum, chromium, tin, aluminum, antimony, titanium, or tungsten. Mixtures of modifier oxides may also be used.

Most preferably, the modifier oxide is selected from the group consisting of zirconium, vanadium, and lead, or mixtures of these, with zirconium being the most preferable of these.

The amount of modifier oxide metal or metals may be in the range of zero to about 50 mole %, most preferably about 5 to about 20 mole % of the total metal of the coating deposited on the electroconductive substrate. Percentages, as expressed, represent mole percent of metal, as metal, in the total metal content of the coating. The modifier oxide is conveniently prepared along with the $Co_3O_4$ from thermally decomposable metal compounds, which may be inorganic metal compounds or organic metal compounds.

The $Co_3O_4$ coatings of the present invention (with or without the modifier oxides) are conveniently prepared by repeated applications of inorganic cobalt salt compounds, each application (or layer) being thermally decomposed to yield the metal oxide. The coating step is repeated as necessary until the desired thickness (preferably about 0.01 to about 0.08 mm) is reached. The inorganic cobalt compound may be any inorganic cobalt compound which, when thermally decomposed, gives the spinel structure, $Co_3O_4$. For example, the inorganic cobalt compound employed as the precursor of the $Co_3O_4$ may be cobalt carbonate, cobalt chlorate, cobalt chloride, cobalt fluoride, cobalt hydroxide, cobalt nitrate or mixtures of two or more of these compounds. Preferably the cobalt compound is at least one compound selected from the group consisting of cobalt carbonate, cobalt chloride, cobalt hydroxide and cobalt nitrate. Most preferably, cobalt nitrate is employed. The suitability of an inorganic cobalt compound for use in the present invention is easily assessed by determining if the compound will thermally decompose to give the single metal spinel, $Co_3O_4$.

The application of inorganic cobalt compounds to the substrate may be done by any of the methods commonly known to practitioners of the relevant arts, such as brushing, spraying, dipping, pouring, or painting.

The examples which follow hereinafter demonstrate forming of the oxide coatings by thermally decomposing appropriate inorganic cobalt compounds.

The formation of the single-metal spinel crystalline structure was shown by X-ray diffraction. This technique for establishing the existence of single-metal spinels is commonly used and details of this technique are found in, e.g., *X-Ray Diffraction Procedures* by H. P. Klug and L. E. Alexander, John Wiley & Sons, N.Y.C. (1954).

A preferred method of preparing the single-metal spinel coatings of the present invention is as follows:

(1) Prepare the substrate by chemically or abrasively removing oxides and/or surface contaminants.
(2) Coat the substrate with the desired thermally-decomposable inorganic cobalt compound (e.g., one or more cobalt salts of inorganic acids) and
(3) heat the coated substrate to a temperature high enough, and for a time sufficient, to decompose the coating and yield the $Co_3O_4$ coated substrate. For most compounds, e.g., the cobalt nitrate, temperatures in the range of about 200°–600° C. and baking times of about 2–60 minutes are generally preferred.

In some cases the inorganic cobalt compound, especially its hydrated form, may be applied to the substrate as a molten material. Ordinarily, the inorganic cobalt compound is carried in an inert, relatively volatile carrier such as water, acetone, alcohols, ethers, aldehydes, ketones, or mixtures of these. As used here, the term "inert" is used to indicate that the carrier or solvent does not prevent the formation of the desired $Co_3O_4$; the term "relatively volatile" indicates the carrier or solvent is driven off during the process of depositing the $Co_3O_4$ coating on the substrate.

When high baking temperatures are employed, the baking time is held to short periods of time in order to obtain the best results. When low baking temperatures are employed, longer baking times are used to assure essentially complete conversion of the inorganic cobalt compounds to metal oxides. If temperatures as high as 600° C. are used, baking time should be held to only a few minutes, say about 2 minutes. When temperature is as low as 200° C., baking times of as much as 60 minutes may be used. Baking temperatures much above 600° C. should be avoided in order to avoid destruction of the single-metal spinel structure, $Co_3O_4$.

It is not desired that the invention be limited by the following theoretical explanation and it is offered only as a plausible explanation of the interaction between heating time and heating temperature which is observed in the practice of the invention. It is believed that holding the coating substrate at a given temperature for unnecessarily long periods of time can allow oxygen migration to penetrate the coating and reach the substrate, thereby reducing the effectiveness of the coated substrate as an anode. It is also believed that increased periods of heating time, such as received by each coating at the time subsequent coatings are made, cause densification or loss of porosity in the coating, thereby improving the impermeability to oxygen. Thus, it is preferred to employ only enough heating time for the first coat (or first few coats) to substantially form the $Co_3O_4$. For this first coat, it is preferred that a maximum temperature of about 400°–450° C. be employed with a maximum heating time of about 15–20 minutes. As more coatings are added, the undercoatings appear to densify and higher temperature or longer heating time may be employed for subsequent coatings. Ordinarily, at least four coatings of the $Co_3O_4$ are performed, preferably at least six. The final coating is given extra baking time in order that it may undergo densification thereby becoming less permeable to oxygen and also become less likely to slough-off during handling and operation.

The optimum temperature and time of baking can be determined experimentally for a given metal compound or mixtures of compounds. The step of coating and baking can be repeated as many times as is necessary to achieve the desired coating thickness. Generally, a coating thickness of about 0.01 to about 0.08 mm is desired. As stated hereinbefore, the amount of modifier oxide metal or metals in the single-metal spinel coating can vary from 0 to about 50 mole percent of the total metal in the coating. Above this range of concentration the $Co_3O_4$ coating can no longer be characterized as principally comprising only a structure of crystals of a single-metal spinel. As the mole ratio of spinel metal/modifier metal in the coating approaches 1/1, the crystallinity, as shown by X-ray diffraction, is found to diminish considerably.

As will be easily recognized by skilled artisans, the measurement given for thickness or depth of these types of coatings is, essentially, an average value. It will also be recognized that the thinner the coating is, the greater will be the chance that "pin-holes" or defects in the coating will occur. The best coatings (i.e., having fewest pin-holes and defects) are obtained by applying the coating as a plurality of layers so as to "build-up" to the desired thickness. Coatings less than about 0.01 mm are likely to suffer from defects which will limit their efficiency. Coatings greater than about 0.08 mm are operable, but the greater thickness provides no improvement which is commensurate with the added expense of building-up such thicker coating.

By employing the coating techniques described and referred to above, thin single-metal spinel coatings, with or without modifier oxides contained therein, may be applied to electroconductive substrates of any convenient shape or form, e.g., mesh, plate, sheet, screen, rod, cylinder, or strip.

As used herein, the expressions "film" or "coating", in referring to the single-metal spinel structure, means that a layer of the single-metal spinel structure is deposited onto, and adheres to, the substrate, even though the layer may actually be "built-up" by a plurality of applications of the oxide or oxide-forming material. The single-metal spinel of $Co_3O_4$ is sufficiently adherent to the substrate for most applications; however, the use of the "modifier oxides" generally improves the adherence, hardness, and toughness of the coating.

As used herein, the expression "contained", when referring to the modifier oxide in the spinel structures, means that the modifier oxides are essentially homogeneously or evenly distributed through the single-metal spinel structure.

In the following embodiments, the thickness of the coatings applied is estimated to be in the range of about 0.5 mil to about 3 mils (i.e., about 0.01 mm to about 0.08 mm). The reason for estimating rather than directly measuring the thickness is because the best methods for performing the measuring involve destruction of the coating. Thus, it is recommended that the coating technique be studied first on specimens which can be sacrificed rather than tested as electrodes. Once it is learned what thickness can be expected by a given coating method, taking into account the number of layers applied, then further coatings can be prepared with the reasonable expectation that substantially the same thickness of coating will again be obtained.

It has been determined that when coatings are applied by a plurality of layer applications, as in the following examples, each subsequent layer is not the same thickness as the preceding layer. Therefore, a coating built-up of, say twelve layers is not twice as thick as a coating built-up of six layers.

In most applications in which the electrodes of the present invention are useful, current densities in the range of about 0.2 to 2.0 amps/in$^2$ (0.03 to 0.3 amps/cm$^2$) are commonly employed. The following examples employ a current density of 0.5 amps/in$^2$ (0.077 amp/cm$^2$) which is considered to be within the normal range for the cells used in the examples.

EXAMPLES AND EMBODIMENTS OF THE INVENTION

The type of test cell utilized in the following Examples was a conventional diaphragm chlorine cell. The diaphragm was deposited from an asbestos slurry onto an iron screen cathode in the conventional manner. Anode and cathode were each approximately 3" × 3" (7.62 cm × 7.62 cm). Current was brought to the electrodes by a brass rod brazed to the cathode and a titanium rod welded to the anode. The distance from the anode to the diaphragm face was approximately ¼-inch (0.635 cm), except as noted below. Temperature of the cell was maintained at 80° ± 3° C. A 300 gpl sodium chloride solution was fed continuously to the anolyte compartment via a constant overflow system. Chlorine, hydrogen, and sodium hydroxide solution were withdrawn continuously from the cell. Anolyte and catholyte levels were adjusted to maintain an NaOH concentration in the catholyte of about 100 gpl. Power was supplied to the cell by a current-regulated power supply. Electrolysis was conducted at an apparent current density of 0.5 amp per square inch (0.77 amp per $cm^2$) anode area.

The etching solution used in some of the examples below was prepared by mixing 25 ml analytical reagent hydrofluoric acid (48% HF by wt), 175 ml analytical reagent nitric acid (approximately 70% $NHO_3$ by wt), and 300 ml deionized $H_2O$.

In the following examples, the "brushing" following the dipping operation is done to avoid "runs" and to assure a smooth uniform coating. An extended heating period of the final coat anneals and densifies the coating.

EXAMPLE I

An ASTM Grade 1 titanium sheet approximately 3" × 3" × 0.080" was immersed in HF-$HNO_3$ etching solution for 15 seconds, washed with deionized water and dried. It was then blasted with $Al_2O_3$ grit to a uniform rough surface and dipped in coating solution, prepared by dissolving reagent grade $Co(NO_3)_2.6H_2O$ in sufficient technical grade acetone to give a cobalt concentration of 2.5 moles per liter of solution. After dipping, the anode was brushed, baked in a 400° C. oven about 10 minutes, removed, and cooled in air about 10 minutes. A second coat was then brushed on, baked at 400° C. for 10 minutes, removed, and cooled in air 10 minutes. Twenty-one additional coats were applied in a similar manner. A twenty-fourth coat was applied and baked 60 minutes at 400° C. The anode was placed in a test cell and operated continuously as described above. Initial voltage was 2.942V; voltage after 275 days continuous operation was 2.934V.

EXAMPLE II

An ASTM Grade 1 titanium sheet approximately 3" × 3" × 0.080" was immersed in HF-$HNO_3$ etching solution for 30 seconds, washed with deionized water and dried. It was then blasted with $Al_2O_3$ grit to a uniform rough surface and brushed with coating solution prepared by dissolving reagent grade $Co(NO_3)_2.6H_2O$ in sufficient deionized water to give a cobalt concentration of 4.0 moles per liter. After brushing, the anode was baked in a 400° C. oven about 10 minutes, removed, and cooled in air about 10 minutes. A second coat was then brushed on, baked at 400° C. for 10 minutes and cooled in air 10 minutes. Nineteen additional coats were applied in a similar manner. A twenty-second coat was applied and baked 60 minutes at 400° C. The anode was placed in a test cell and operated continuously as described above. Initial voltage was 3.114V; voltage after 250 days continuous operation was 3.047V.

EXAMPLE III

An ASTM Grade 1 titanium sheet approximately 3" × 3" × 0.080" was immersed in HF-$HNO_3$ etching solution for 30 seconds, washed with deionized water and dried. It was then blasted with $Al_2O_3$ grit to a uniform rough surface and brushed with a coating solution prepared by dissolving reagent grade $Co(NO_3)_2.6H_2O$ and technical grade $ZrO(NO_3)_2.H_2O$ in sufficient deionized water to give a cobalt concentration of 4.44 moles per liter and a zirconium concentration of 0.41 moles per liter. After brushing, the anode was baked in a 400° C. oven about 10 minutes, removed, and cooled in air about 10 minutes.

Twenty-one additional coats were applied in a similar manner. A twenty-fourth coat was applied and baked 60 minutes at 400° C. The anode was placed in a test cell and operated continuously as described above. Initial voltage was 3.112V; voltage after 225 days continuous operation was 2.988V.

EXAMPLE IV

A piece of ASTM Grade 1 titanium expanded mesh approximately 3" × 3" × 0.080" was immersed in HF-$HNO_3$ etching solution for 30 seconds, washed with deionized water and dried. One face only of the mesh was then blasted to a uniform rough surface. The blasted face was immediately brushed with a coating solution prepared by dissolving reagent grade $Co(NO_3)_2.6H_2O$ in sufficient technical grade acetone to give a cobalt concentration of 2.5 moles per liter. After brushing, the anode was baked in a 400° C. oven about 10 minutes. A second coat was then brushed onto the blasted face, baked at 400° C. for 10 minutes, removed and cooled in air 10 minutes. Nine additional coats were applied in a similar manner. A twelfth coat was applied to the blasted face and baked 60 minutes at 400° C. The small quantity of coating adhering to the unblasted face was then abraded off. The anode was placed in a test cell with the uncoated face essentially touching the front face of the diaphragm. The cell was operated continuously as described above. Initial voltage was 2.892V; voltage after 200 days continuous operation was 2.875V.

EXAMPLE V

An ASTM Grade 1 titanium sheet approximately 3" × 3" × 0.080" was immersed in HF-$HNO_3$ etching solution for 30 seconds, washed with deionized water and dried. It was then blasted with $Al_2O_3$ grit to a uniform rough surface and immediately brushed with a coating solution prepared by dissolving reagent grade $Co(NO_3)_2.6H_2O$ in sufficient technical grade acetone to give a cobalt concentration of 2.5 moles per liter. The anode was then baked in a 250° C. oven for about 10 minutes, removed and cooled in air about 10 minutes. Ten additional coats were applied in a similar manner. A twelfth coat was applied and baked 60 minutes at 250° C. The anode was placed in a test cell and operated continuously as described above. Initial voltage was 2.920V; voltage after 130 days continuous operation was 3.013V.

EXAMPLE VI

An ASTM Grade 1 titanium sheet approximately 3" × 3" × 0.080" was blasted with $Al_2O_3$ grit to a uniform rough surface and immediately brushed with a coating solution prepared by dissolving reagent grade $Co(NO_3)_2.6H_2O$ in sufficient technical grade acetone to give a cobalt concentration of 2.5 moles per liter. One face of the sheet was then placed approximately 2" from the grid of a gas-fired infrared generator and heated for $1\frac{1}{2}$ minutes. The calculated average anode temperature after this period was 270° C. The anode was then cooled by forced air for three minutes, given a second coat, and baked similarly for $1\frac{1}{2}$ minutes. After cooling by forced air for three minutes, the anode was given a third and final coat, placed similarly, and baked for $2\frac{1}{2}$ minutes, reaching a calculated average temperature of 340° C. The anode was placed in a test cell and operated continuously as described above. Initial voltage was 2.881V; voltage after 14 days continuous operation was 2.894V.

EXAMPLE VII

An ASTM Grade 1 titanium sheet approximately 3" × 3" × 0.080" was dipped in 1,1,1-trichloroethane solvent, air dried, immersed in HF-$HNO_3$ etching solution for 30 seconds, washed with deionized water and dried. It was then blasted with $Al_2O_3$ grit to a uniform rough surface and immediately dipped into molten purified grade $Co(NO_3)_2.6H_2O$ salt at 70° C. The anode was then brushed to remove excess material and baked in a 400° C. oven 5 minutes. After cooling 5 minutes, the anode was again dipped into molten $Co(NO_3)_2.6H_2O$, brushed dry, baked at 400° C. for 5 minutes and cooled 5 minutes. Three additional coats were applied in a similar manner. A sixth and final coat was applied in like manner, except that it was baked 60 minutes at 400° C. The anode was placed in a test cell and operated continuously as described above, except that the cell was heated to only 70° C. Initial cell voltage was 2.945V; voltage after 18 days continuous operation was 2.946V.

EXAMPLE VIII

An ASTM Grade 1 titantium sheet approximately 3" × 3" × 0.080" was dipped in 1,1,1-trichloroethane solvent, air dried, immersed in HF-$HNO_3$ etching solution for 30 seconds, washed with deionized water, and air dried. The front face was then blasted with $Al_2O_3$ grit to a uniform rough surface and brushed with a coating solution prepared by dissolving purified grade $Co(NO_3)_2.6H_2O$ and reagent grade $Pb(NO_3)_2$ in sufficient deionized water to give a cobalt concentration of 3.60 moles per liter and a lead concentration of 0.18 moles per liter. After brushing, the anode was baked in a 400° C. oven 5 minutes, removed and cooled 5 minutes. Four additional coats were applied in a similar manner. A sixth coat was applied and baked 60 minutes at 400° C. The anode was placed in a test cell and operated continuously as described above, except that the cell temperature was 70° C. Initial cell voltage was 2.970V; voltage after 15 days continuous operation was 2.979V.

EXAMPLE IX

An ASTM Grade 1 titanium sheet approximately 3" × 3" × 0.080" was dipped in 1,1,1-trichloroethane, air dried, dipped in HF-$HNO_3$ etching solution for 30 seconds, washed with deionized water, and air dried. The front face was then blasted with $Al_2O_3$ grit to a uniform rough surface and the front face was brushed with a coating solution prepared by dissolving purified grade $Co(NO_3)_2.6H_2O$ in sufficient dimethyl formamide to give a cobalt concentration of 1.86 moles per liter. After brushing the anode was baked in a 400° C. oven for about 10 minutes, removed and cooled in air about 10 minutes. Four additional coats were applied in a similar manner. A sixth coat was applied and baked 60 minutes at 400° C. The anode was placed in a test cell containing an experimental low-voltage cathode and operated continuously as described above, except that the cell temperature was 70° C. Initial cell voltage was 2.793V; voltage after 11 days continuous operation was 2.770V.

EXAMPLE X

A piece of ASTM Grade 1 titanium expanded mesh approximately 3" × 3" × 0.080" was dipped in 1,1,1-trichloroethane, air dried, dipped in HF-$HNO_3$ etching solution for 30 seconds, washed with deionized water, and air dried. It was then blasted with $Al_2O_3$ grit to a uniform rough surface and immediately brushed with a coating solution 4.0 molar in cobalt, prepared by dissolving purified grade $Co(NO_3)_2.6H_2O$ in deionized water, the entire solution containing 5% (vol.) Dowanol PM ® propylene glycol methyl ether. One face of the piece was then placed approximately 2" from the grid of a gas-fired infrared generator and heated for 2½ minutes. The calculated average anode temperature after this period was 350° C. The anode was then cooled by forced air for 2½ minutes, given a second coat, and baked similarly for 2½ minutes. Ten additional coats were applied in similar fashion. After the twelfth coat had been heated by the generator 2½ minutes, the anode was placed in a 400° C. convection oven and baked 60 minutes. The anode was placed in a test cell and operated continuously as described above, except at 70° C. Initial cell voltage was 2.873V; voltage after 47 days continuous operation was 2.871V.

EXAMPLE XI

Anode blanks containing titanium surfaces are chemically and mechanically cleaned and are coated with solutions of $Co(NO_3)_2.6H_2O$ in methanol, ethanol, and/or t-butanol. The anodes are baked in a 400° C. oven for about 10 minutes, removed, and cooled in air about 10 minutes. A number of coats are applied in similar fashion, the final coat being baked for 60 minutes. The anodes so-prepared are eminently suited for the electrolysis of brine.

EXAMPLE XII (Comparative experiment using organic cobalt as in U.S. Pat. No. 3,977,958)

An ASTM Grade 1 titanium plate 3" × 3" × 5/64" was blasted with $Al_2O_3$ grit to a uniform rough surface, blown clean with air, soaked briefly in dimethyl fomamide, and allowed to air dry. A coating mixture was prepared by mixing 121.56 g "Cobalt Octoate" (12% Co) with 34.28 g "Zirconium NuXtra" (6% Zr). The "Cobalt Octoate" (12% Co), and "Zirconium Nu Xtra" (6% Zr) are metal salts of fatty acids diluted with mineral spirits and are sold by Tenneco Chemicals, Inc. (see teachings in U.S. Pat. No. 3,977,958).

The coating mixture was brushed onto the cleaned titanium plate. The plate was baked in a 400° C. oven about 15 minutes, removed, and cooled in air about 10 minutes. Eleven more coats were applied in a similar manner. The plate was then allowed to stand overnight in air. Eleven further coats were then applied in a similar manner, and a final coat was applied and baked 60 minutes at 400° C. The anode was placed in a test cell and operated continuously as described above. Initial voltage was 3.049V; voltage after 333 days continuous operation was 3.304V.

EXAMPLE XIII (Comparative experiment using organic cobalt as in U.S. Pat. No. 3,977,958)

An ASTM Grade 1 titanium plate 3" × 3" × 5/64" was blasted with $Al_2O_3$ grit to a uniform rough surface, blown clean with air, soaked briefly in dimethyl formamide, and allowed to air dry. A solution of "Cobalt Octoate" (12% Co by weight) was brushed onto the cleaned titanium plate. The plate was baked about 15 minutes in a 400° C. oven, removed, and cooled in air about 10 minutes. Sixteen more coats were applied in a similar manner. The anode was then placed in a dessicator overnight. Eighteen more coats were than applied in a similar fashion. A 36th coat was applied and the anode was then baked 62 minutes at 400° C. The anode was placed in a test cell and operated continuously as described above. Initial voltage was 3.199V; voltage after 258 days continuous operation was 3.535V.

EXAMPLE XIV (Comparative experiment usng graphite anode)

A piece of graphite material approximately 3" × 3" × 1¼" was cut and threaded in the center of this piece and a threaded graphite rod inserted to provide electrical contact. The piece of graphite was placed in a test cell and operated continuously as described above. pH of the feed brine was controlled at 2.0 ± 0.5. Initial voltage was 3.052V; voltage after 296 days continuous operation was 3.217V. Considerable wear and loss of dimension of this graphite anode was evident.

We claim:

1. A process for preparing improved electrolytic cell anodes comprising an electrically-conductive substrate having a coating consisting essentially of a single-metal spinel, $Co_3O_4$, the said process comprising (a) providing an electrically-conductive substrate substantially free of foreign matter or oxide film, (b) applying to the substrate a thin coating of a thermally decomposable inorganic cobalt compound which, when thermally decomposed in the presence of oxygen gives $Co_3O_4$, (c) heating the so-coated substrate at a temperature in the range of about 200° C. to about 600° C. in an oxidizing atmosphere for a time sufficient to oxidize the inorganic cobalt compound to $Co_3O_4$, then cooling it, and (d) repeating the above coating step (b) and heating step (c) until the layer of $Co_3O_4$ on the substrate has a thickness in the range of about 0.01 mm to about 0.08 mm.

2. The process of claim 1 wherein there is simultaneously applied to the substrate along with the cobalt compound an oxide-forming modifier metal compound selected from the group consisting of metals of the Periodic Table of the Elements Groups III-B, IV-B, V-B, VI-B, VII-B, Lanthanides, Actinides, III-A, IV-A, and V-A, the said modifier metal compound being in an amount to provide, as oxide, up to 50% of the total weight of the metal of the coating.

3. The process of claim 2 wherein the oxide-forming metal compound is a compound of a metal selected from the group consisting of cerium, bismuth, lead, vanadium, zirconium, tantalum, niobium, molybdenum, chromium, tin, aluminum, antimony, titanium, and tungsten and mixtures of these.

4. The process of claim 3 wherein the metal is zirconium, vanadium, lead or mixtures of these.

5. The process of claim 1 wherein the inorganic cobalt compound is applied to the substrate in an inert, relatively volatile carrier.

6. The process of claim 5 wherein the carrier is selected from the group consisting of water, alcohol, aldehyde, ketone, ether and mixtures of these.

7. The process of claim 1 wherein the inorganic cobalt compound is cobalt nitrate dissolved in water, acetone or a mixture of water and acetone.

8. The process of claim 1 wherein the inorganic cobalt compound is at least one compound selected from the group consisting of cobalt nitrate, cobalt carbonate, cobalt hydroxide, cobalt chlorate, cobalt chloride and cobalt fluoride.

9. The process of claim 1 wherein the electroconductive substrate comprises a film-forming metal.

10. The process of claim 1 wherein the electroconductive substrate comprises a metal selected from the group consisting of titanium, tantalum, tungsten, zirconium, molybdenum, niobium, hafnium, and vanadium.

11. The process of claim 1 wherein the electroconductive substrate comprises a metal selected from the group consisting of titanium, tantalum, and tungsten.

12. The process of claim 1 wherein the electroconductive substrate comprises titanium or titanium alloys.

13. The process of claim 1 wherein the electroconductive substrate is in the form of a mesh, plate, sheet, screen, rod, cylinder, or strip.

14. In the process of preparing an electrolytic cell anode comprising an electroconductive substrate having a coating consisting essentially of $Co_3O_4$, said coating being deposited on said substrate by (a) applying a thermally-decomposable cobalt compound to the substrate, (b) then heating at a temperature in the range of about 200° C. to about 600° C. in an oxidizing atmosphere to form the $Co_3O_4$, and (c) cooling the so-coated substrate and repeating steps (a) and (b) and (c) a plurality of times, the improvement which comprises the use of an inorganic cobalt compound as the thermally-decomposable cobalt compound.

15. The process of claim 14 wherein the electroconductive substrate is titanium and wherein the inorganic cobalt compound is cobalt nitrate.

16. The process of claim 14 wherein the inorganic cobalt compound is cobalt nitrate carried in acetone, water, or a mixture of acetone and water.

* * * * *

UNITED STATES PATENT AND TRADEMARK OFFICE

CERTIFICATE OF CORRECTION

PATENT NO. : 4,142,005

DATED : February 27, 1979

INVENTOR(S) : Donald L. Caldwell, et al

It is certified that error appears in the above-identified patent and that said Letters Patent are hereby corrected as shown below:

Col. 3, line 48; change "Aluminium" to --Aluminum--.

Col. 5, line 13; change "coating" to --coated--.

Col. 7, line 6; change "$NHO_3$" to --$HNO_3$--.

Col. 10, line 63; change "than" to --then--.

Col. 11, line 1; change "usng" to --using--.

Col. 12, line 35; insert --organic-- between "thermally-decomposable" and "cobalt".

Signed and Sealed this

Tenth Day of July 1979

[SEAL]

*Attest:*

*Attesting Officer*

LUTRELLE F. PARKER

*Acting Commissioner of Patents and Trademarks*